United States Patent [19]

Waterman

[11] 4,019,268

[45] Apr. 26, 1977

[54] APPARATUS FOR COMPACTING SNOW FOR SKIING

[75] Inventor: Donald Herbert Waterman, Poland Springs, Maine

[73] Assignee: Valley Engineering, Inc., Gray, Maine

[22] Filed: Nov. 1, 1976

[21] Appl. No.: 737,522

[52] U.S. Cl. ..... 37/10; 37/41; 37/42 R; 172/180; 172/777; 172/779; 404/91

[51] Int. Cl.[2] ..... B30B 9/00

[58] Field of Search ..... 37/10, 41, 42 R; 172/180, 413, 777, 779, 784; 404/91; 280/405 R

[56] References Cited

UNITED STATES PATENTS

| | | | |
|---|---|---|---|
| 1,089,427 | 3/1914 | Moody | 37/41 |
| 1,421,559 | 7/1922 | Prendergast | 172/784 X |
| 3,368,292 | 2/1968 | Prinoth | 37/10 |
| 3,371,586 | 3/1968 | Nikolaev et al. | 404/91 |
| 3,477,151 | 11/1969 | Zanella | 37/42 |
| 3,650,343 | 3/1972 | Helsell | 37/10 X |
| 3,652,106 | 3/1972 | Waterman | 280/405 R |
| 3,685,404 | 8/1972 | Rich et al. | 172/777 X |
| 3,711,970 | 1/1973 | Briar | 172/413 X |
| 3,755,930 | 9/1973 | Brandt et al. | 37/10 |
| 3,807,064 | 4/1974 | Schmidt, Jr. | 37/41 |

*Primary Examiner*—E. H. Eickholt

[57] ABSTRACT

This invention is directed to an apparatus for compacting snow for skiing and snowmobiling. It includes an elongated snow compacting member with means which permit its ends to move upwardly and downwardly so that when one end contacts an elevated snow surface that end automatically moves upwardly to substantially equalize the p.s.i. exerted by the snow compacting member against the snow which is being compacted. It also includes snow compacting wings which extend outwardly from and are pivotally secured to the central snow compacting section of the snow compactor and power means for rotating the wings upwardly. The outer ends of the wings are secured to the inner ends by shear bolts or pins so that when an outer end contacts a rigid object it falls away and is not damaged. Means is provided for adjusting the angle of attack of the bottom wall of the snow compacting element to the surface of the snow to vary the pressure exerted upon it. Power means is also provided for moving the elements of the snow compacting apparatus above the rear portion of the towing vehicle for transporting the snow compactor to and from ski trails and to and from the locality where the compacting apparatus is stored. Snow roller means is provided to partially compact the snow between the tracks of the towing vehicle as the compactor is moved forwardly so that the snow beneath the roller is partially compacted to about the same density as the snow which is partially compacted by the tracks of the vehicle.

8 Claims, 14 Drawing Figures

APPARATUS FOR COMPACTING SNOW FOR SKIING

BACKGROUND OF THE INVENTION

This invention relates to apparatus for compacting snow for skiing, snowmobiling and the like and more particularly to such an apparatus which is attachable to flat bed vehicles provided with hydraulic power.

The proper grooming of trails for skiing or snowmobiling areas requires apparatus for compacting fluffy new fallen snow for preservation and smoothing for skiing. Frequently steep slopes, changing snow conditions and trails which vary in width are involved. In addition, elevated snow surfaces at intervals laterally of the trail as well as rocks or hard lumps of snow or ice concealed beneath the surface of the snow are involved. A snow compacting apparatus should be provided which will accommodate itself to the foregoing conditions.

The following U.S. patents have suggested partial solutions to some of the above conditions:

| Patent No. | Inventor | Date of Application |
|---|---|---|
| 1,089,427 | Moody | March 13, 1913 |
| 3,368,292 | Pinoth | June 16, 1965 |
| 3,371,586 | Nikolaev | July 30, 1965 |
| 3,477,151 | Zanella | July 16, 1965 |
| 3,685,404 | Rich | July 24, 1970 |
| 3,755,930 | Brandt | December 18, 1970 |
| 3,807,064 | Schmidt, Jr. | April 30, 1974 |

The snow compacting apparatus of this invention is a great improvement upon the above prior art and it satisfies the long-felt want for a snow compacting apparatus which is operative in the above described conditions which are found in areas in which the snow must be compacted for skiing or snowmobiling.

BRIEF SUMMARY OF THE INVENTION

One object of this invention is to provide a new and efficient apparatus for compacting snow for skiing.

Another object is to provide such an apparatus which is durable in use.

Another object is to provide such an apparatus which is efficient in use.

A further object is to provide such an apparatus which can be operated over uneven terrain and which automatically adjusts itself so that the p.s.i. exerted by the bottom surface of the compacting elements against the snow surface is equalized.

Yet another object is to provide such an apparatus which includes snow compacting wings pivoted to the ends of a central snow compacting member and power means for moving the wings upwardly about such pivotal connections for transporting the apparatus to and from ski trails and for storage when not in use.

A still further object is to provide such an apparatus with wings which include shear means so that when a wing contacts a rigid object at least part of the wing falls away preventing damage to the remainder of the snow compacting apparatus.

Another object is to provide such wings with means for preventing loss of the part of the wing which falls away.

Yet another object is to provide such an apparatus which includes means for adjusting the angle of attack of the snow compacting surfaces of the compacting elements to the surface of the snow which is being compacted.

Still another object is to provide such an apparatus with means for elevating it to a position above the rear portion of the towing vehicle for transport of the apparatus to and from the ski areas and for storage when it is not in use.

Further objects and advantages of this invention will be apparent to persons skilled in the art from the following description taken in conjunction with the accompanying drawings.

In general, an apparatus for compacting snow embodying this invention includes an elongate central section having a substantially flat bottom wall, first elongate frame means substantially parallel to said central section when viewed from the top, means for securing the first elongate frame means to the central section, second elongate frame means substantially parallel to the first elongate frame means and located forwardly thereof, pivot means located substantially at the centers of the first and second frame means for providing pivotal movement of the first frame means and the central section relative to the second frame means, and third elongate frame means secured to the second frame means and extending substantially normal thereto. Thus, when the compacting apparatus is moved forwardly over uneven terrain and one end portion of the central section contacts an elevated snow surface, it moves upwardly about the pivot means thus substantially equalizing the p.s.i. exerted by the substantially flat bottom wall of the compactor against the snow being compacted.

In a preferred embodiment, the apparatus also includes extension members on the ends of the first and second frame means, registering transverse slots in the extension members and guide means extending through the slots.

Yet another preferred embodiment includes wing means extending outwardly from one end of the central section having one end which is contiguous to the adjacent end of the central section, the wing means is provided with a substantially flat bottom wall and an outer portion which is inclined forwardly at an oblique angle from the longitudinal centerline of the inner portion thereof, second pivot means for providing movement of the wing means upwardly relative to the central section, and power means connected between the central section and the wing means for moving the wing means upwardly about the second pivot means to an elevated position.

In another preferred embodiment, the apparatus also includes means for securing the wing means in its elevated position without reliance upon the power means.

In a still further preferred embodiment, the wing means include a first wing section, one end of which is contiguous to the adjacent end of the central section, first flange means positioned transversely of the other end of the first wing section, a second wing section located outwardly of the first wing section, second flange means positioned transversely of the inner end of the second wing section, registering apertures extending through the first and second flange means, shear means extending through the apertures, and elongate flexible means for attaching the first wing section to the adjacent portion of the second wing section. Thus, when the second wing section contacts a rigid object as the compactor is moved forwardly, the shear means is fractured, the second wing section falls away from the first wing section and the elongate flexible means prevents loss of the second wing section.

In another preferred embodiment, the apparatus also includes means for adjusting the angle of the substantially flat bottom wall of the central section of the snow compactor relative to the surface of the snow, means for pivotally securing the rear end of that adjusting means to the central section and means for pivotally securing the forward end of the adjusting means to the first frame means at a locality which is below the means for pivotally securing the adjusting means to the forward end. With this construction, by rotation of the adjusting means in either direction, the angle of the substantially flat bottom wall relative to the surface of the snow which is to be compacted may be varied, thereby to vary the pressure exerted by the substantially flat bottom wall on the surface of the snow.

In yet another preferred embodiment, the apparatus also includes third elongate frame means having one end secured to the second frame means and extending substantially normal thereto, fourth elongate frame means, third pivot means for pivotally securing the forward end of the third frame means to the fourth frame means, and power means for moving the fourth frame means upwardly to a position above the rear portion of a towing vehicle. With this construction, the first, second and third frame means and the snow compacting elements are elevated to positions above said towing vehicle for transportation to and from the ski trails and for storage when not in use.

In still another preferred embodiment, the apparatus also includes a roller rotatably secured between the third frame means. The length of the roller is substantially equal to the distance between the tracks of a vehicle for towing the compacting apparatus. Accordingly, when the snow compactor is moved forwardly, the snow beneath the roller is compacted to about the same density as the snow compacted by the tracks of the vehicle.

It will be apparent to persons skilled in the art that this invention has solved the above described long-felt want and satisfied the above described objects.

and

Figure 13:
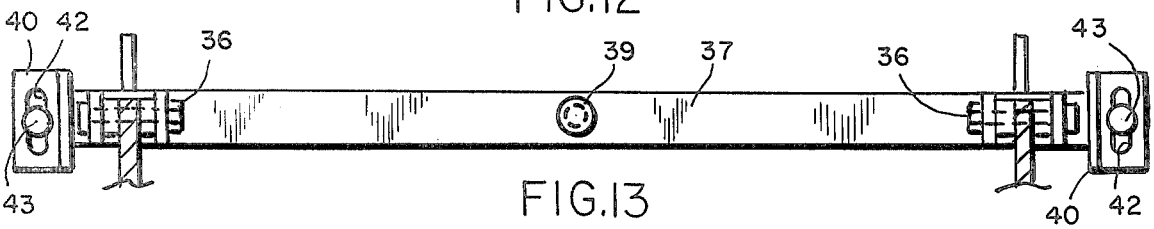
FIG. 13 is a section taken on the line 13—13 of FIG. 12.
Figure 14:
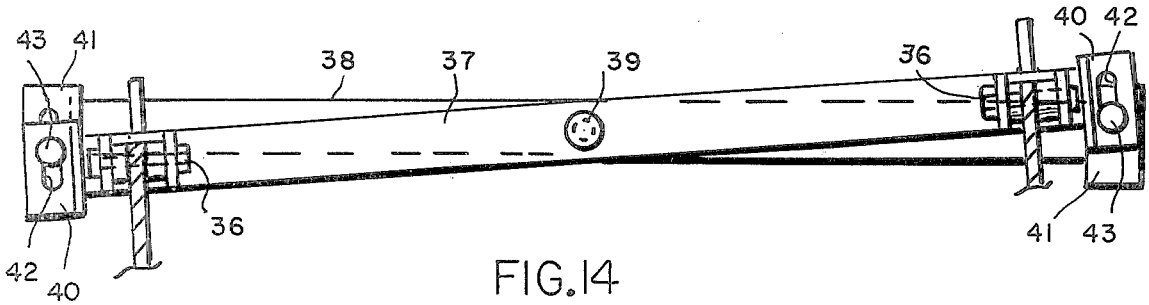

FIG. 14 is a very similar to FIG. 13 but with the first frame means moved about its pivotal connection to the second frame means.

DETAILED DESCRIPTION OF THE EMBODIMENT SHOWN IN THE DRAWINGS

Referring to FIGS. 1, 4, 5 and 6 of the drawings, the numeral 15 designates the apparatus for compacting snow as a whole. It is attached to the flat bed 16 of a vehicle 17 which is preferably equipped with endless tracks 18.

The snow compacting portion of the apparatus comprises an elongate central section 20 and a pair of wings 21.

Each wing comprises an inner wing section 21A and an outer wing section 21B. In snow compacting position, the inner end of inner wing section is contiguous to the adjacent end of the central section 20 as shown in FIGS. 2, 4, 7 and 8.

Figures 4, 9:
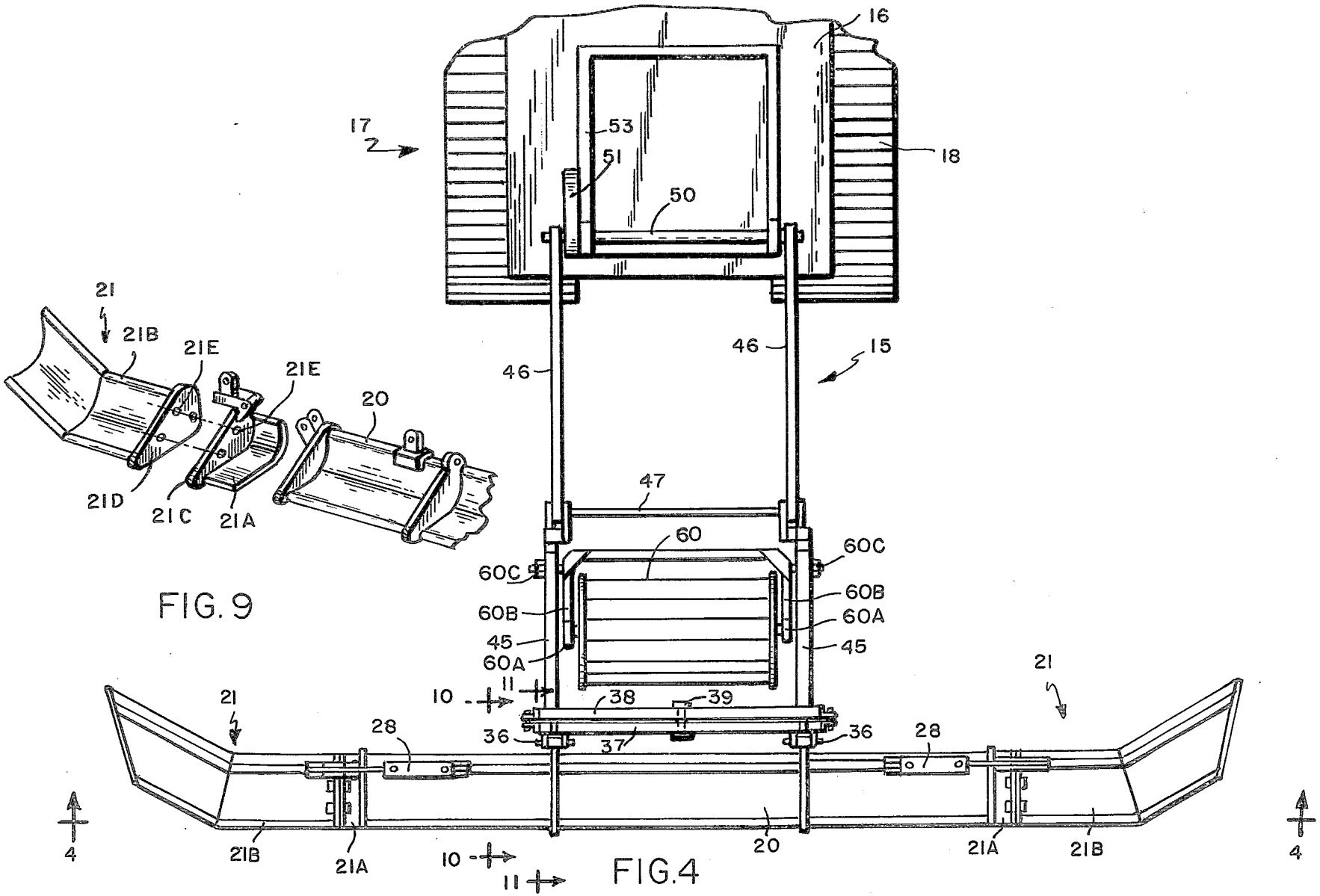
FIG. 4 is a top plan view of the rear of the towing vehicle and the compacting apparatus in its lowered position.
FIG. 9 is an exploded isometric view showing the left-hand portion of the central section of the snow compactor, an inner end wing section and an outer end wing section with apertures for receiving shear means.

First flange means 21C extends transversely of the outer end of the inner wing section and second flange means 21D extends transversely of the inner end of the outer wing section as shown in FIG. 9. These flanges are provided with a series of registering apertures 21E (FIG. 9) and shear bolts 21F (FIGS. 7 and 8) extend through the apertures.

A chain or other flexible means 23 (FIG. 7) has one end attached at 24 to the outer wing section and its other end attached at 25 to the inner wing section. When a wing strikes a rock or tree, the shear bolts break thus preventing damage to the outer wing section and the flexible means retains the outer wing section so that it will not be lost in the snow where it would be likely to injure a skier.

Figure 8:
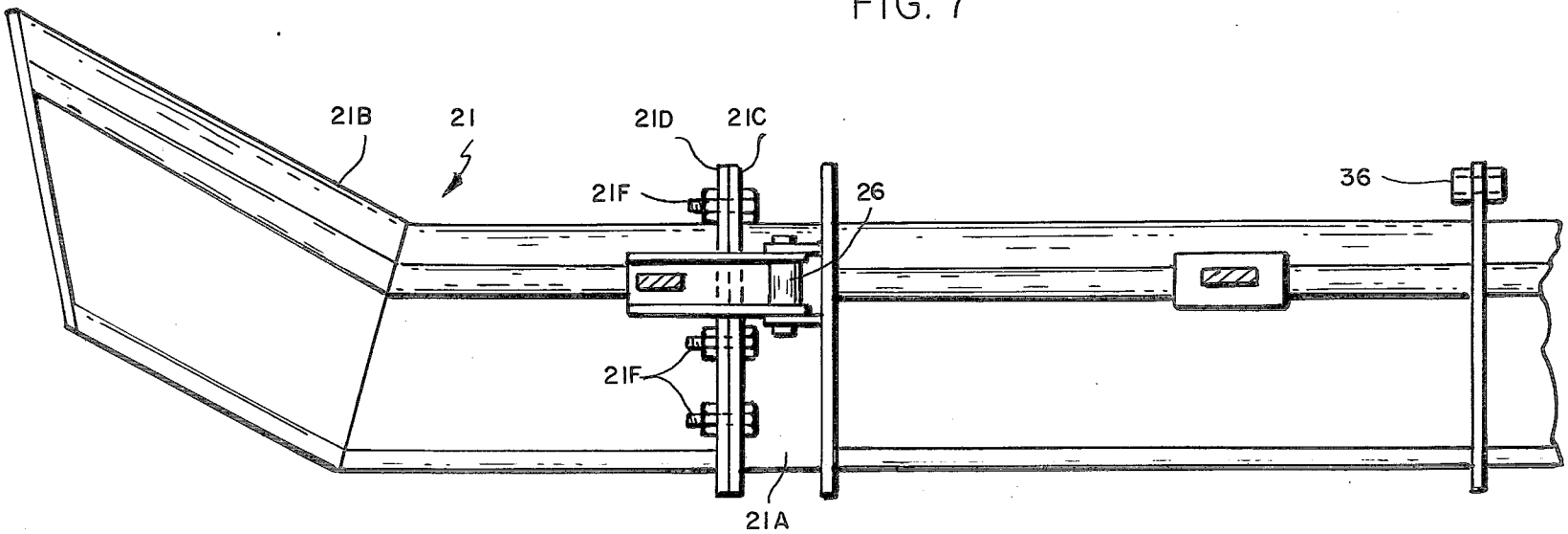
FIG. 8 is a plan view taken on the line 8—8 of FIG. 7.

The outer portions of the outer wing sections are inclined forwardly about 30° from the centerline of the central section as shown in FIGS. 4 and 8 thereby to direct the snow inwardly and prevent the formation of ridges when a second path is compacted to overlap the first path. Thus, a smoothly compacted surface is provided for both paths.

Figure 2:
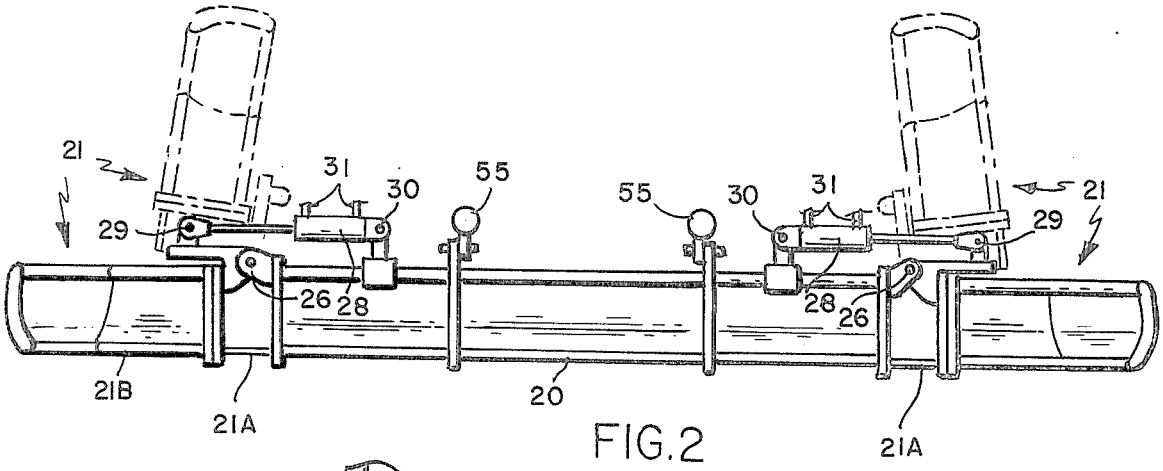
FIG. 2 is a rear elevational view of the snow compacting apparatus shown in FIG. 1 with its end wings shown in dot dash positions after they have been rotated upwardly into inoperative positions.
Figure 3:
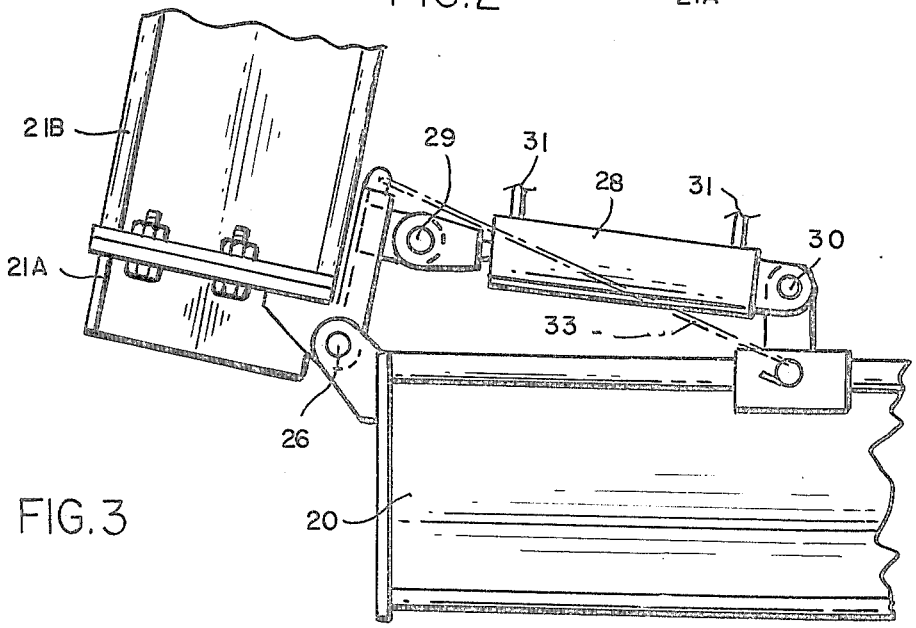
FIG. 3 is an enlarged rear elevational view like FIG. 2 but with parts broken away and with the end wing rotated upwardly.
Figure 7:
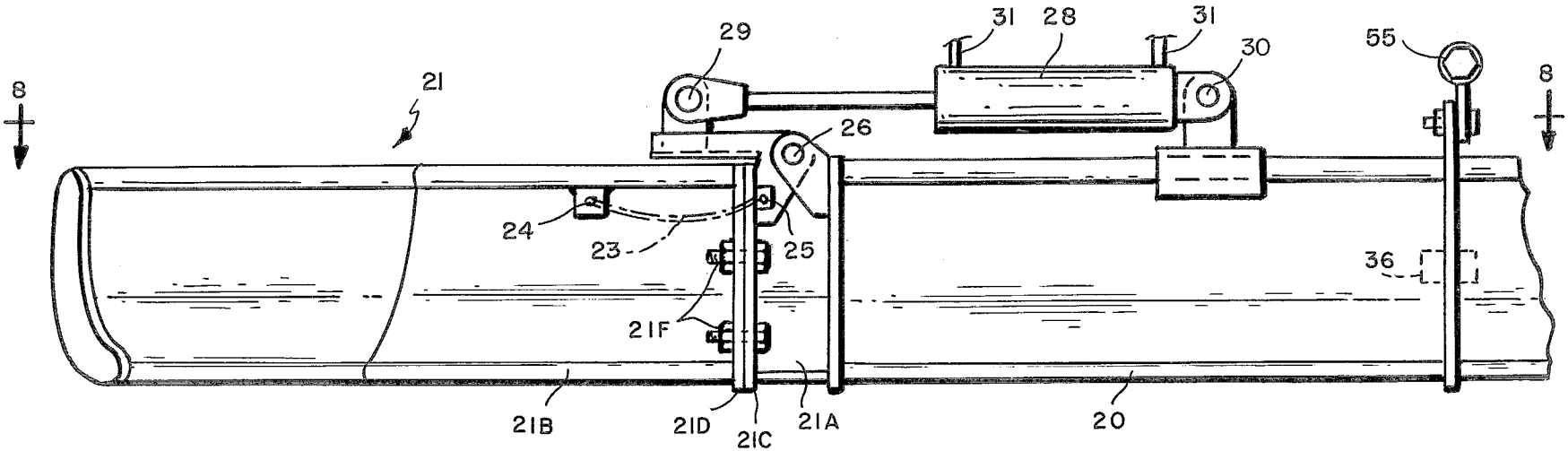
FIG. 7 is an enlarged rear elevational view similar to FIG. 2 but with the right-hand portion of the snow compacting apparatus broken away.

Each wing is pivotally secured to an end of the central section by a horizontal pivot 26 (FIGS. 2, 3 and 7). Two double acting hydraulic motor means 28 are provided. Their rams are pivotally attached at 29 to the inner wing sections and the ends of their cylinders are pivotally attached at 30 to the central section 20. Hydraulic lines 31 are connected between the cylinders and a hydraulic power unit of the vehicle so the operator can control the hydraulic motor means from his seat in the cab of the vehicle.

When the rams are retracted, they cause the wings to be rotated upwardly from the full line positions to the dot dash positions of FIG. 2 and they are maintained in those positions when the apparatus is transported to and from a ski slope or to storage. When the rams are extended, the wings are rotated downwardly to their positions shown in FIGS. 1, 2, 4 and 7.

Detachable chains 33 (FIG. 3) or other flexible means are provided for use in holding the wings in their elevated positions without reliance upon the hydraulic motor means.

Figure 11:
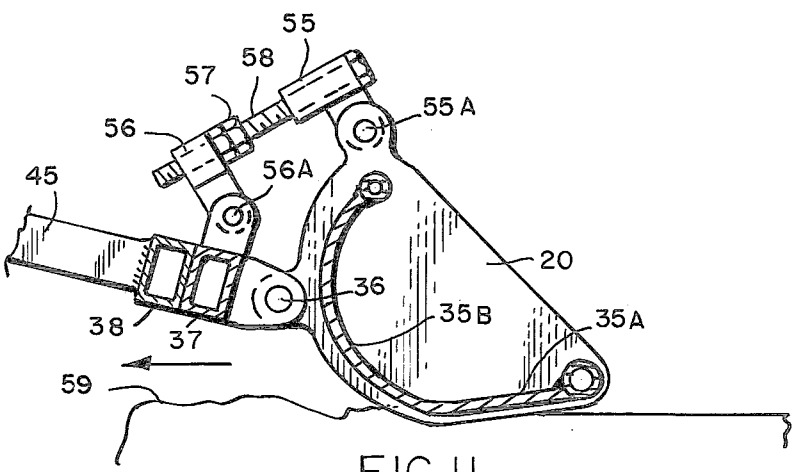
FIG. 11 is a section taken on the line 11—11 of FIG. 4 showing the flat bottom wall of the snow compactor inclined upwardly from its position shown in FIG. 10.
Figure 10:
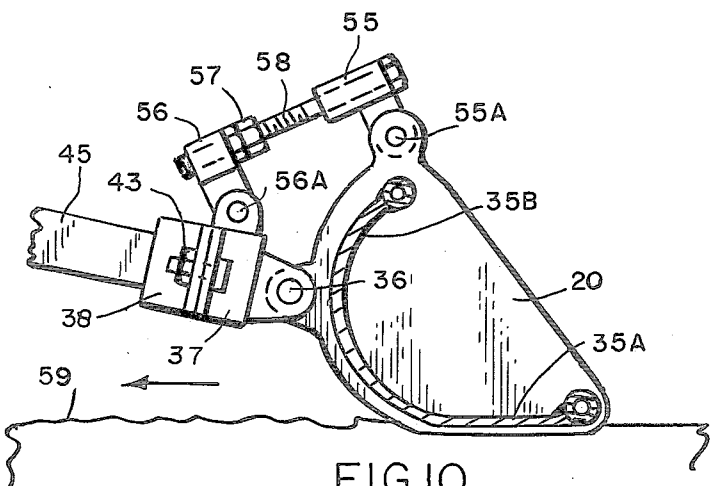
FIG. 10 is an enlarged section taken on the line 10—10 of FIG. 4 showing means for adjusting the angle of the substantially flat bottom wall of the snow compactor relative to the surface of the snow.

As shown in FIGS. 10 and 11, the pans of the snow compacting elements comprise a substantially flat bottom wall 35A and an arcuate forward wall 35B.

As best shown in FIGS. 4, 10, 11, 12 and 13, the central section 20 of the snow compactor is pivotally secured at 36 to a first elongate frame means 37 which is substantially parallel to the central section. A second elongate frame means 38 is substantially parallel to the first frame means and they are pivotally secured together by the pivot means 39. Extension members 40 and 41 (FIGS. 12, 13 and 14) are provided on the ends of these frame means. They are provided with slots 42 through which the bolts 43 loosely pass.

Figure 1:
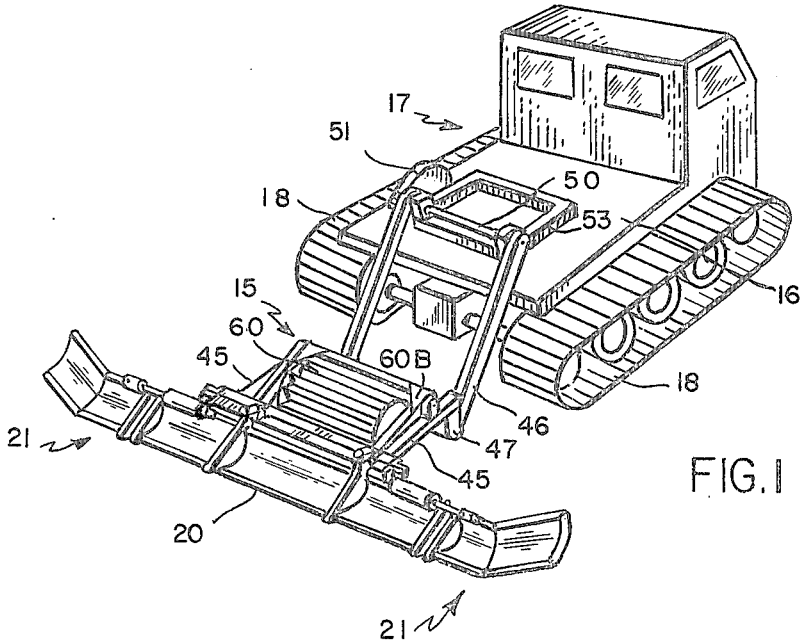
FIG. 1 is a perspective view showing an apparatus for compacting snow embodying this invention in operative position behind a vehicle for towing it.
Figure 12:
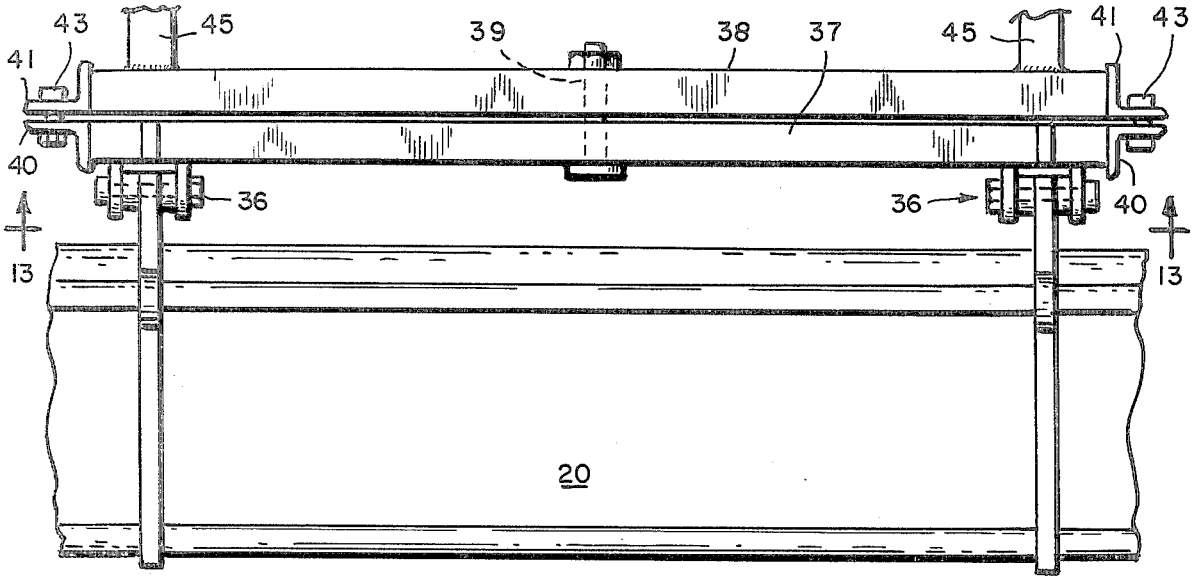
FIG. 12 is an enlarged top plan view of part of the central portion of the snow compactor and first and second elongate frame means pivotally secured to each other near their centers.

The second frame means 38 is rigidly secured as by weldments to the rear ends of a pair of third frame means 45 which extend substantially normal to the second frame means as shown in FIGS. 1, 4 and 12.

Figure 5:
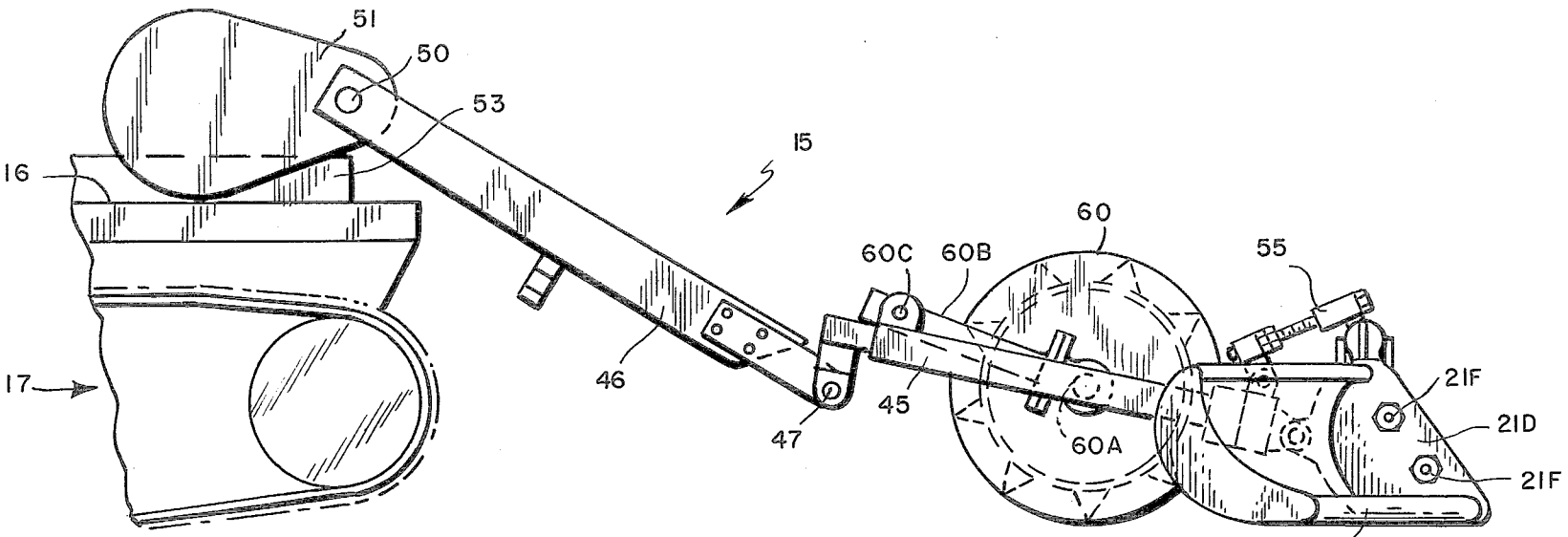
FIG. 5 is a view in side elevation of the apparatus shown in FIG. 4.

Fourth frame means 46 have their rear ends pivotally attached by pivot means 47 to the forward ends of the third frame means as shown in FIGS. 1, 4 and 5.

The forward ends of the fourth frame means are secured to the shaft 50 of the reversible hydraulic unit 51 which receives power fluid from the hydraulic power unit of the vehicle.

The box frame 53 (FIGS. 1 and 4) is detachably but rigidly secured to the bed of the vehicle.

To transport the snow compacting apparatus to a ski slope or to storage, first the wings 21 are rotated upwardly to the dot dash positions of FIG. 2 by the hydraulic means 28. Then the fourth frame means 46 are rotated counterclockwise (looking at FIG. 5) by the reversible hydraulic unit 51 from their position shown in FIGS. 1 and 5 to their position shown in FIG. 6 and that causes the third frame means 45 and the snow compacting elements 20, 21A and 21B to be elevated and folded to positions above the bed of the vehicle.

To lower those elements to the positions shown in FIGS. 1 and 5, the reversible hydraulic unit 51 and the hydraulic means 28 are operated in the opposite directions.

Referring to FIGS. 10 and 11, the interiorly threaded element 55 is pivotally secured at 55A to the central section 20 of the compactor and the interiorly threaded element 56 is pivotally secured at 56A to the first element 37. The exteriorly threaded adjustment bolt 58 passes through the elements 55 and 56 and by loosening the lock nuts 57 and rotating the adjustment bolt in one direction, the angle of contact of the substantially flat bottom walls 35A of the snow compacting elements with the snow surface 59 can be varied, thereby to vary the pressure exerted by the flat bottom wall upon the snow surface — compare FIGS. 10 and 11.

Referring to FIGS. 1, 4 and 5, the snow roller 60 is rotatably secured by bearings 60A between the arms 60B which are pivotally attached to the third frame members 45 by the pivot means 60C. The length of the roller is substantially equal to the spacing between the tracks 18 of the vehicle. As the vehicle moves forwardly, the snow roller is rotated and it compacts the snow beneath it to about the same density as the snow which is compacted by the tracks of the tractor. Consequently, when the flat bottom walls 35A of the central and wing sections of the compactor come in contact with the thus compacted snow surface, they are operating upon a snow surface which is of substantially the same density throughout its width.

Figure 6:
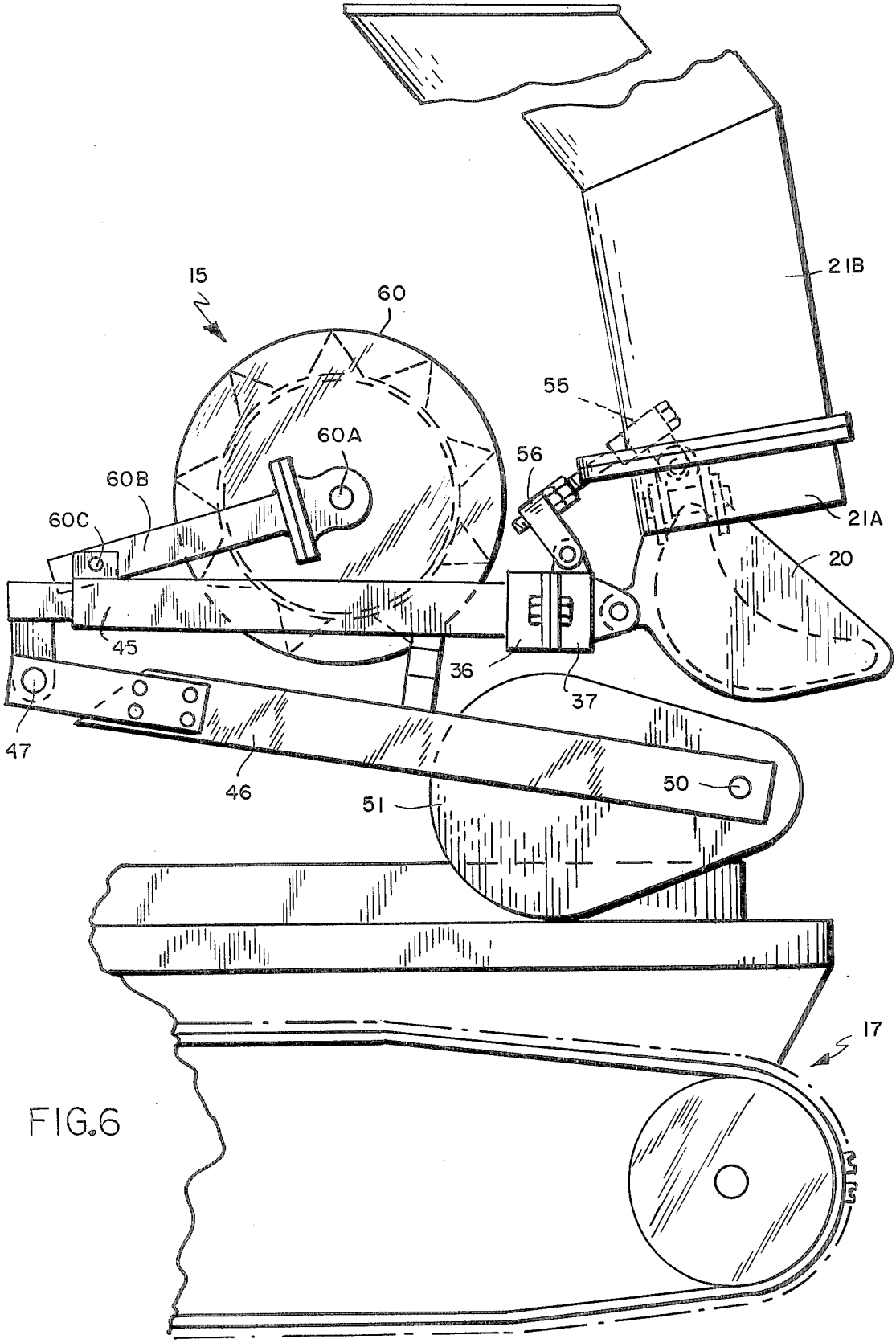
FIG. 6 is a side elevation of the rear of the towing vehicle and the snow compacting apparatus with the wings rotated upwardly as in FIG. 3 and the compacting appartus moved upwardly and folded above the bed of the vehicle in a position for transport to a ski slope or to storage.

When the snow compacting apparatus is moved upwardly and folded by the reversible hydraulic unit 51, the snow roller is also carried upwardly and it assumes the position shown in FIG. 6.

It will be apparent to persons skilled in the art that apparatus for compacting snow embodying this invention has met the long-felt need and has satisfied the above described objects.

While one desirable embodiment of apparatus for compacting snow embodying the invention has been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. An apparatus for compacting snow for sking comprising, an elongate central section having a substantially flat bottom wall, first elongate frame means substantially parallel to said central section when viewed from the top, means for securing said first elongate frame means to said central section, second elongate frame means substantially parallel to said first elongate frame means and located forwardly thereof, first pivot means located substantially at the centers of said first and second frame means for providing pivotal movement of said first frame means and said central section relative to said second frame means, and third elongate frame means secured to said second frame means and extending substantially normal thereto, whereby as the compacting apparatus is moved forwardly over uneven terrain and one end portion of said central section contacts an elevated snow surface the said one end portion of the central section moves upwardly about said first pivot means thus substantially equalizing the p.s.i. exerted by said substantially flat bottom wall against the snow being compacted.

2. Apparatus according to claim 1 which also comprises extension members on the ends of said first and second frame means, registering transverse slots in said extension members and guide means extending through said slots.

3. Apparatus according to claim 1 which also comprises, wing means extending outwardly from one end of said central section having one end which is contiguous to the adjacent end of said central section, said wing means having a substantially flat bottom wall and an outer portion which is inclined forwardly at an oblique angle from the longitudinal centerline of the inner portion thereof, second pivot means for providing movement of said wing means upwardly relative to said central section, and power means connected between said central section and said wing means for moving said wing means upwardly about said second pivot means to an elevated position.

4. Apparatus according to claim 3 which also comprises means for securing said wing means in its elevated position without reliance upon said power means.

5. Apparatus according to claim 3 wherein said wing means comprises, a first wing section one end of which is contiguous to the adjacent end of said central section, first flange means positioned transversely of the other end of said first wing section, a second wing section located outwardly of said first wing section, second flange means positioned transversely of the inner end of said second wing section, registering apertures extending through said first and second flange means, shear means extending through said apertures, and elongate flexible means for attaching said first wing section to the adjacent portion of said second wing section, whereby when said second wing section contacts a rigid object as the compactor is moved forwardly said shear means is fractured, the second wing section falls away from said first wing section and said elongate flexible means prevents loss of said second wing section.

6. Apparatus according to claim 1 which also comprises, means for adjusting the angle of the substantially flat bottom wall of the central section of the snow compactor relative to the surface of the snow, means for pivotally securing the rear end of said adjusting means to said central section and means for pivotally securing the forward end of said adjusting means to said first frame means at a locality which is below said means for pivotally securing said forward end, whereby by rotation of said adjusting means in either direction the angle of said substantially flat bottom wall relative to the surface of the snow which is to be compacted may be varied, thereby to vary the pressure exerted by said substantially flat bottom wall on the surface of the snow.

7. Apparatus according to claim 1 which also comprises, third elongate frame means having one end secured to said second frame means and extending substantially normal thereto, fourth elongate frame means, third pivot means for pivotally securing the forward end of said third frame means to said fourth frame means, and power means for moving said fourth frame means upwardly to a position above the rear portion of a towing vehicle, whereby said first, second and third frame means and said snow compacting elements are elevated to positions above said towing vehicle.

8. Apparatus according to claim 1 which also comprises, roller means rotatably secured between said third frame means, the length of said roller means being substantially equal to the distance between the tracks of a vehicle for towing the compacting apparatus, whereby as the snow compactor is moved forwardly, the snow beneath the roller is compacted to about the same density as the snow compacted by the tracks of the vehicle.

* * * * *